US008270886B2

(12) United States Patent
Minbu et al.

(10) Patent No.: US 8,270,886 B2
(45) Date of Patent: Sep. 18, 2012

(54) TRANSFER NIP ROLLER, TRANSFER DEVICE, AND IMAGE FORMING APPARATUS

(75) Inventors: Ryuuichi Minbu, Kanagawa (JP); Hiromi Ogiyama, Tokyo (JP); Junroh Uda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 752 days.

(21) Appl. No.: 12/073,394

(22) Filed: Mar. 5, 2008

(65) Prior Publication Data

US 2008/0232867 A1 Sep. 25, 2008

(30) Foreign Application Priority Data

Mar. 19, 2007 (JP) ..... 2007-070561

(51) Int. Cl.
*G03G 15/20* (2006.01)

(52) U.S. Cl. ..... 399/313; 399/297; 399/307

(58) Field of Classification Search ..... 399/297, 399/313, 307
See application file for complete search history.

(56) References Cited

U.S. PATENT DOCUMENTS

| | | | | |
|---|---|---|---|---|
| 5,483,330 | A | 1/1996 | Ogiyama et al. | |
| 5,732,314 | A * | 3/1998 | Tsukida et al. | 399/302 |
| 5,982,606 | A | 11/1999 | Masuda et al. | |
| 6,192,205 | B1 * | 2/2001 | Motohashi | 399/66 |
| 6,312,792 | B1 * | 11/2001 | Okada et al. | 428/220 |
| 6,618,565 | B2 | 9/2003 | Tamiya et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,901,234 | B2 | 5/2005 | Ogiyama et al. | |
| 6,947,693 | B2 | 9/2005 | Kamiya et al. | |
| 7,003,238 | B2 | 2/2006 | Yoshida et al. | |
| 7,532,370 | B2 | 5/2009 | Kudo et al. | |
| 2003/0118359 | A1 | 6/2003 | Ogiyama et al. | |
| 2005/0013636 | A1 | 1/2005 | Sawai et al. | |
| 2006/0056884 | A1 | 3/2006 | Sawai et al. | |
| 2006/0127116 | A1 | 6/2006 | Ogiyama et al. | |
| 2006/0127134 | A1 * | 6/2006 | Sakamaki et al. | 399/223 |
| 2007/0258737 | A1 | 11/2007 | Ogiyama et al. | |

FOREIGN PATENT DOCUMENTS

| | | |
|---|---|---|
| JP | 10-293438 | 11/1998 |
| JP | 2004-117674 | 4/2004 |
| JP | 2004-184875 | 7/2004 |
| JP | 2006-091122 | 4/2006 |

OTHER PUBLICATIONS

Office Action dated Sep. 30, 2011 for corresponding Japanese patent application No. 2007-070561.

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

In a transfer nip roller operative to transfer an image from an image carrier to a recording medium, a ratio (We3/Wt3)/(We30/Wt30) is 0.47 or more, where We3 is an elastic workload and Wt3 is a total workload measured by applying a load on a covering portion under a load push-in condition of 3 mN/10 seconds, and We30 is an elastic workload and Wt30 is a total workload measured by applying a load on the covering portion under a load push-in condition of 30 mN/10 seconds.

20 Claims, 4 Drawing Sheets

TRANSFER NIP ROLLER, TRANSFER DEVICE, AND IMAGE FORMING APPARATUS

CROSS-REFERENCE TO RELATED APPLICATIONS

The present application claims priority to and incorporates by reference the entire contents of Japanese priority document 2007-070561 filed in Japan on Mar. 19, 2007.

BACKGROUND OF THE INVENTION

1. Field of the Invention

The present invention relates to a transfer nip roller, a transfer device, and an image forming apparatus.

2. Description of the Related Art

A transfer nip roller described in Japanese Patent Application Laid-open Publication No. 2004-117674 has been known. The transfer nip roller comes in contact with the surface of an endlessly moving intermediate transfer belt to form a transfer nip. Through the effect of a transfer bias supplied from a power supply, a toner image on the intermediate transfer belt is transferred onto a recording sheet nipped in the transfer nip. The base material of the transfer nip roller is a core having a shaft supported rotatably on a bearing, and the peripheral surface of the roller portion of the core is covered with a covering portion having an elastic layer and a surface layer. In this configuration, contact pressure acting on the transfer nip deforms the elastic layer freely to enhance the adhesion between the transfer nip roller and the intermediate transfer belt and form a wider transfer nip. Moreover, using a material having a smaller friction coefficient, such as fluororesin, as the surface layer formed independent of the elastic layer suppresses the adhesion of toner to the surface of the transfer nip roller.

The transfer nip roller, however, has a problem that a crack is easily formed on the surface layer. Specifically, the surface made of a material showing a better parting property against toner is inferior in elasticity to the elastic layer, but is forced to deform pursuant to the elastic deformation of the elastic layer underneath the surface layer on the transfer nip. When the transfer nip roller passes through the transfer nip to allow the elastic layer to return to its original form, the surface layer, following the move of the elastic layer, also returns to its original form. If the surface layer repeats such forced deformation and recovery, a crack is eventually formed on the surface layer as a result of a fatigue failure at a local spot. The crack formed on the surface layer catches toner to accumulate it inside the crack, and accumulated toner is eventually transferred to a recording sheet to cause the back soiling of the recording sheet.

A conventional transfer nip roller sometimes causes such a crack in a short period from the initial state to the completion of printing of several ten thousands of sheets. The conventional transfer nip roller, therefore, needs to be replaced every time printing of several ten thousands of sheets is over. This results in cost burden and maintenance burden on a user. A demand for lower cost and better maintenance efficiency is high in these days, and such a demand leads to a call for the development of a transfer nip roller having a lifetime long enough to withstand workload of printing of about 300,000 sheets.

SUMMARY OF THE INVENTION

It is an object of the present invention to at least partially solve the problems in the conventional technology.

According to an aspect of the present invention, there is provided a transfer nip roller operative to transfer an image from an image carrier to a recording medium, the transfer nip roller that includes a core; a covering portion that covers a surface of the core and includes a surface layer and an elastic layer that is made of an elastic material and arranged closer to the core than the surface layer, wherein a ratio (We3/Wt3)/(We30/Wt30) is 0.47 or more, where We3 is an elastic workload and Wt3 is a total workload measured by applying a load on the covering portion under a load push-in condition of 3 mN/10 seconds, and We30 is an elastic workload and Wt30 is a total workload measured by applying a load on the covering portion under a load push-in condition of 30 mN/10 seconds.

According to another aspect of the present invention, there is provided a transfer device that includes: an image carrier that carries a toner image on a surface thereof; and a transfer nip roller operative to transfer an image from an image carrier to a recording medium, the transfer nip roller including a core; a covering portion that covers a surface of the core and includes a surface layer and an elastic layer that is made of an elastic material and arranged closer to the core than the surface layer, wherein a ratio (We3/Wt3)/(We30/Wt30) is 0.47 or more, where We3 is an elastic workload and Wt3 is a total workload measured by applying a load on the covering portion under a load push-in condition of 3 mN/10 seconds, and We30 is an elastic workload and Wt30 is a total workload measured by applying a load on the covering portion under a load push-in condition of 30 mN/10 seconds.

According to still another aspect of the present invention, there is provided an image forming apparatus that includes: a transfer device including an image carrier that carries a toner image on a surface thereof, and a transfer nip roller operative to transfer an image from an image carrier to a recording medium, the transfer nip roller including a core, a covering portion that covers a surface of the core and includes a surface layer and an elastic layer that is made of an elastic material and arranged closer to the core than the surface layer, wherein a ratio (We3/Wt3)/(We30/Wt30) is 0.47 or more, where We3 is an elastic workload and Wt3 is a total workload measured by applying a load on the covering portion under a load push-in condition of 3 mN/10 seconds, and We30 is an elastic workload and Wt30 is a total workload measured by applying a load on the covering portion under a load push-in condition of 30 mN/10 seconds.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
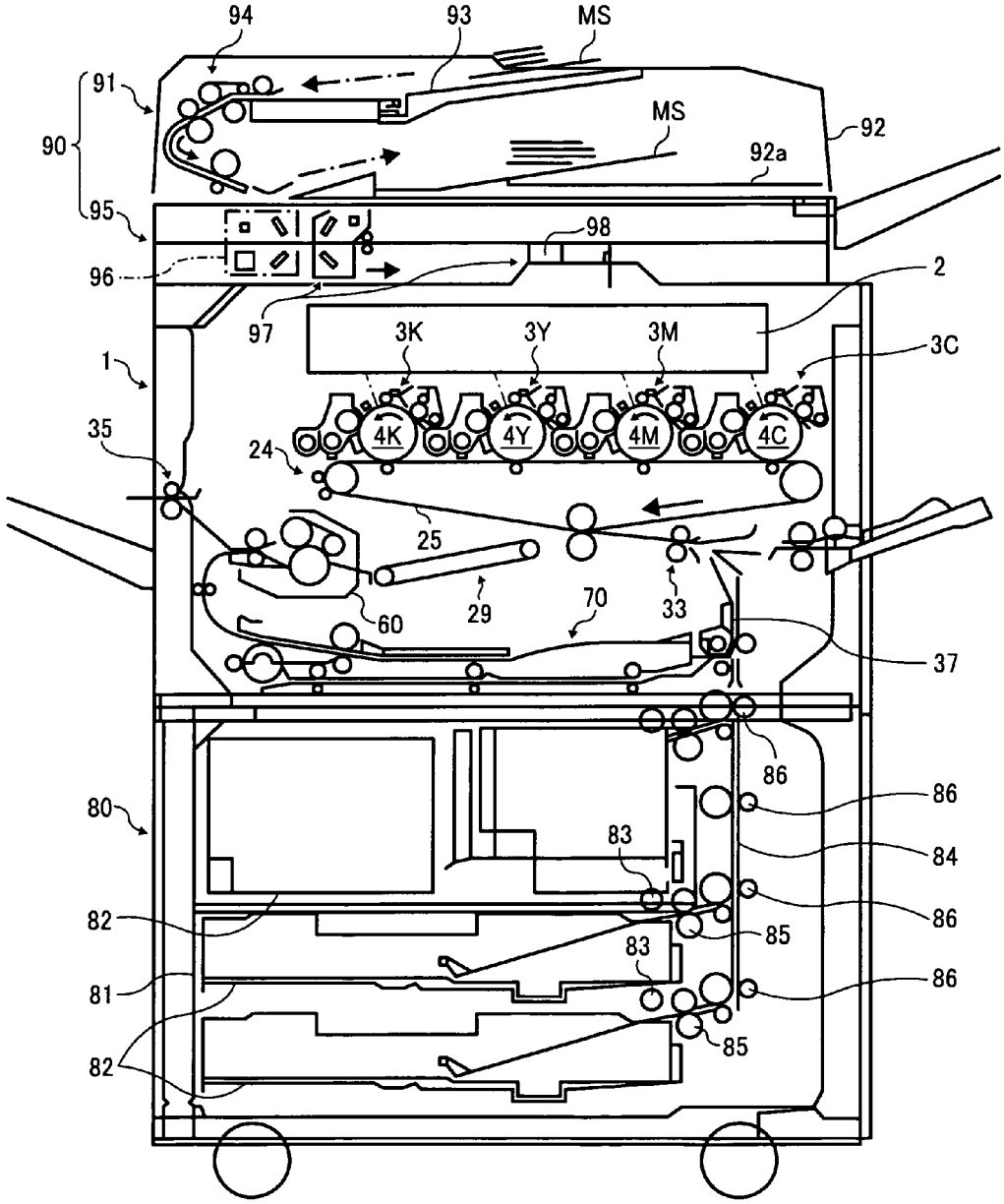
FIG. 1 is a schematic diagram of a copier according to an embodiment.

FIG. 1 is a schematic diagram of an electrophotographic copier (hereinafter, simply "copier") according to an embodiment to which the present invention is applied. The copier includes an image forming apparatus 1, a sheet feeding unit 80 and a manuscript conveying and reading unit 90. The manuscript conveying and reading unit 90 includes a scanner 95 serving as a manuscript reader fixed on the image forming apparatus 1 and an automatic document feeder (ADF) 91 serving as a manuscript conveying unit supported on the scanner 95.

The sheet feeding unit 80 includes two sheet feeding cassettes 82 that are arranged longitudinally in a sheet storing unit 81, sheet feeding rollers 83 that feed a recording sheet, which is a recording medium, from the sheet feeding cassettes 82, separation rollers 85 that separate a single recording sheet from the recording sheets fed by the sheet feeding rollers 83 and supply the recording sheet to a sheet feeding path 84, and a plurality of conveying rollers 86 that conveys the recording sheet to a sheet feeding path 37 in the image forming apparatus 1. The sheet feeding unit 80 thus feeds the recording sheet from the sheet feeding cassettes 82 into the sheet feeding path 37 in the image forming apparatus 1.

Figure 2:
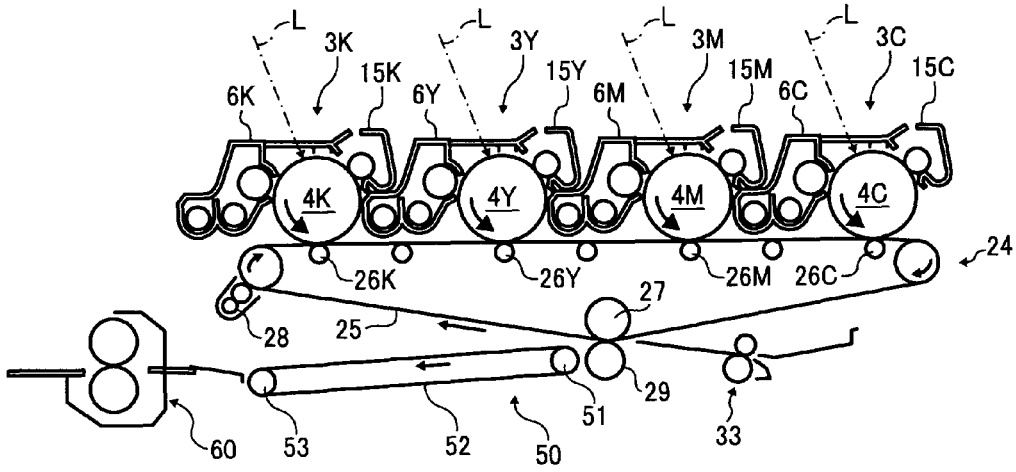
FIG. 2 is a schematic diagram of a part of the internal configuration of an image forming apparatus in the copier.

FIG. 2 is a schematic diagram of a part of the internal configuration of the image forming apparatus 1. The image forming apparatus 1 includes an optical writing unit 2, four process units 3K, 3Y, 3M, and 3C for forming toner images of K, Y, M, and C, a transfer unit 24, a sheet conveying unit 50, a pair of registration rollers 33, a fixing unit 60, a switchback unit 70, and the sheet feeding path 37. The image forming apparatus 1 drives a light source, such as a laser diode (LD) and a light emitting diode (LED) (not shown), placed in the optical writing unit 2 to emit laser light L onto four drum-shaped photosensitive elements 4K, 4Y, 4M, and 4C. As a result, an electrostatic latent image is formed on each of the photosensitive elements 4K, 4Y, 4M, and 4C, which is then developed into a toner image after receiving a predetermined development process. The symbols K, Y, M, and C appended to reference numerals denote black, yellow, magenta, and cyan, respectively.

Each of the process units 3K, 3Y, 3M, and 3C is supported on a common support as one unit including one photosensitive element and various units arranged around the photosensitive element, and can be detached from the image forming apparatus 1. For example, the process unit 3*k* for black includes the photosensitive element 4K, a developing unit 6K for developing an electrostatic latent image formed on the surface of the photosensitive element 4K into a black toner image, and a cleaning unit 15 that removes residual transfer toner adhered to the surface of the photosensitive element 4K having passed through a primary transfer nip for K. The copier has a tandem configuration in which the process units 3K, 3Y, 3M, and 3C arranged to oppose the intermediate transfer belt 25 are aligned along a direction of endless move of the intermediate transfer belt 25.

Figure 3:
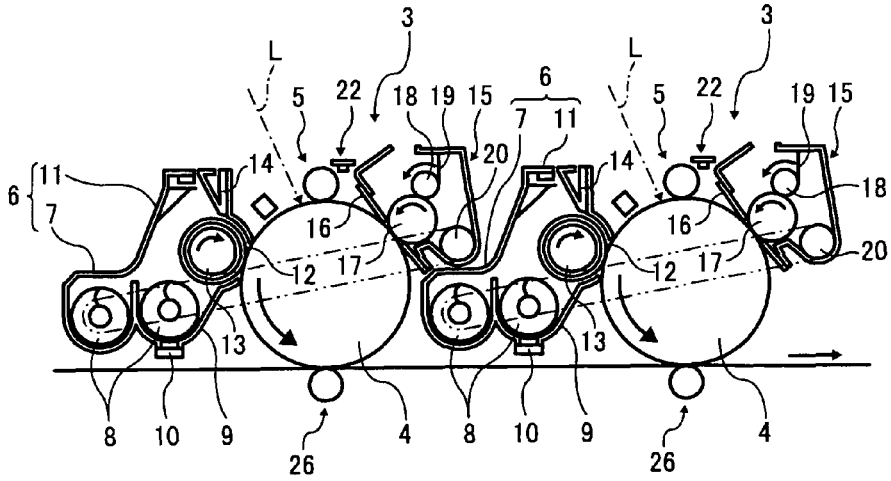
FIG. 3 is a schematic diagram of a part of a tandem unit including four process units in the image forming apparatus.

FIG. 3 is a schematic diagram of a part of a tandem unit including the process units 3K, 3Y, 3M, and 3C. Each of the process units 3K, 3Y, 3M, and 3C virtually has the same configuration except that each uses a toner with different color. In FIG. 3, therefore, the appended symbols K, Y, M, and C are omitted. As shown in FIG. 3, a charging unit 5, the developing unit 6, the cleaning unit 15, and a neutralizing lamp 22 are arranged around the photosensitive element 4 in the process unit 3.

The photosensitive element 4 has a drum shape, and is formed by coating a base pipe made of aluminum or the like with a photosensitive layer made of an organic photosensitive material having photosensitivity. The photosensitive element 4 can be made into an endless belt shape.

The developing unit 6 develops a latent image by a two-component developer containing a magnetism carrier and nonmagnetic toner (not shown). The developing unit 6 includes a stirring part 7 that stirs and carries the two-component developer stored therein to supply the developer to a development sleeve 12, and a developing part 11 that transfers the toner contained in the two-component developer and carried by the development sleeve 12 onto the photosensitive element 4.

The stirring part 7 is arranged at a position lower than the developing part 11, and includes two carrying screws 8 arranged to be parallel with each other, a partition set between the carrying screws 8, and a toner concentration sensor 10 arranged on the bottom of a development case 9.

The developing part 11 includes the development sleeve 12 opposing the photosensitive element 4 through an opening of the development case 9, a magnet roller 13 placed inside the development sleeve 12 to be incapable of rotation, and a doctor blade 14 whose front end approaches the development sleeve 12. The development sleeve 12 is a nonmagnetic, rotary cylinder. The magnet roller 13 has a plurality of magnetic poles that are arranged in order in a direction of rotation of the development sleeve 12 from a position where the magnet roller 13 opposes the doctor blade 14. Each of these magnetic poles causes a magnetic force to act on the two-component developer at a given position in the rotation direction. This magnetic force attracts the two-component developer sent from the stirring part 7 to the surface of the development sleeve 12 to cause the development sleeve 12 to carry the two-component developer, and forms a magnetic brush along magnetic lines on the sleeve surface.

The magnetic brush is reduced in thickness to have a proper film thickness when passing over the position opposing the doctor blade 14 with the rotation of the development sleeve 12, and is carried to a development area opposing the photosensitive element 4, where the magnetic brush contributes to a development process by transferring toner onto an electrostatic latent image utilizing a difference in potential between a development bias applied to the development sleeve 12 and the electrostatic latent image on the photosensitive element 4. Further, with the rotation of the development sleeve 12, the magnetic brush goes back into the developing part 11, where the magnetic brush is separated from the sleeve surface due to the effect of repulsive magnetic fields formed between the magnetic poles on the magnet roller 13, and is sent back into the stirring part 7. In the stirring part 7, the two-component developer is replenished with a proper amount of toner based on a detection result detected by the toner concentration sensor 10. The developing unit 6 can be replaced with another type of developing unit that uses a single-component developer not containing the magnetism carrier instead of using the two-component developer.

The cleaning unit 15 operates in such a way that a cleaning blade 16 made of a polyurethane rubber is pressed to the photosensitive element 4; however, another type of cleansing unit operating in different way can also be employed. To improve cleaning performance, in the present embodiment, the cleaning unit 15 includes a contact conductive fur brush 17 whose outer peripheral surface is brought in contact with the photosensitive element 4 and which is rotatable in a direction indicated by an arrow in FIG. 3. The fur brush 17 also has a function of scraping off a solid lubricant (not shown) and crushing the scraped lubricant into fine powder to apply the powdered lubricant to the surface of the photosensitive element 4. A metal electric field roller 18 applying a bias to the fur brush 17 is provided to be rotatable in a direction indicated by an arrow in FIG. 3, and the front end of a scraper 19 is presses to the electric field roller 18. Toner adhered to the fur brush 17 is moved to the electric field roller 18, which is supplied with an applied bias while being in contact with and rotating in an direction opposite to the fur brush 17. Toner is then scraped from the electric field roller 18 by the scraper 19, and is dropped onto a recovery screw 20. The recovery screw 20 sends recovered toner toward an end of the cleaning unit 15 in the direction perpendicular to the page surface bearing FIG. 3 to deliver recovered toner to an external recycling conveying unit 21, which sends delivered toner back to the developing unit 6 in a recycling process.

The neutralizing lamp 22 neutralizes the photosensitive element 4 by light emission. The neutralized surface of the photosensitive element 4 is uniformly charged by the charging unit 5, and is subjected to an optical writing process by the optical writing unit 2. The charging unit 5 operates in such a way that a charging roller applied with a charging bias is rotated while in contact with the photosensitive element 4. The charging unit 5, however, can be provided as a scorotron charger or the like that carries out a charging process in no contact with the photosensitive element 4.

In FIG. 2, K toner image, Y toner image, M toner image, and C toner image are formed on the photosensitive elements 4K, 4Y, 4M, and 4C of the process units 3K, 3Y, 3M, and 3C, respectively, through the above process.

The transfer unit 24 is disposed under the process units 3K, 3Y, 3M, and 3C. The transfer unit 24 operates in such a way that the intermediate transfer belt 25, which is supported by a plurality of rollers, is moved clockwise endlessly while in contact with the photosensitive elements 4K, 4Y, 4M, and 4C. This forms primary transfer nips for K, Y, M, and C where the photosensitive elements 4K, 4Y, 4M, and 4C are in contact with the intermediate transfer belt 25. Near the primary transfer nips for K, Y, M, and C, primary transfer rollers 26K, 26Y, 26M, and 26C arranged inside the loop of the intermediate transfer belt 25 press the intermediate transfer belt 25 against the photosensitive elements 4K, 4Y, 4M, and 4C. To each of the transfer rollers 26K, 26Y, 26M, and 26C, a primary transfer bias is applied from each power supply (not shown). As a result, primary transfer electric fields for electrostatically moving toner images on the photosensitive elements 4K, 4Y, 4M, and 4C toward the intermediate transfer belt 25 are formed on the primary transfer nips for K, Y, M, and C. As the front surface of the intermediate transfer belt 25 passes through the primary transfer nips for K, Y, M, and C in succession due to the clockwise endless move of the intermediate transfer belt 25, the K toner image, Y toner image, M toner image, and C toner image are transferred primarily onto the front surface while superposed on top of one another in order at the primary transfer nips for K, Y, M, and C. As a result of this superposing primary transfer process, a four-color superposed toner image (hereinafter "four-color toner image") is formed on the front surface of the intermediate transfer belt 25.

The transfer unit 24 serving as a transfer device includes a transfer nip roller 29 under the intermediate transfer belt 25. The transfer nip roller 29 is in contact with the front surface of the intermediate transfer belt 25 at a spot where the intermediate transfer belt 25 is supported by a lower supporting roller 27 to form a secondary transfer nip.

To the lower supporting roller 27 arranged inside the loop of the intermediate transfer belt 25, a secondary transfer bias having a polarity same as that of the charged polarity of toner is applied from a power supply (not shown). In contrast, the transfer nip roller 29 arranged outside the loop of the intermediate transfer belt 25 is grounded electrically. As a result, a secondary transfer electric field for electrostatically moving toner from the side of the lower supporting roller 27 to the side of the transfer nip roller 29 is formed in an area ranging from the lower supporting roller 27 through the secondary transfer nip to the transfer nip roller 29.

The registration rollers 33 are arranged on the right side of the secondary transfer nip in FIG. 2, sending the recording sheet held between the paired rollers to the secondary transfer nip in timing of synchronizing the recording sheet with the four-color toner image on the intermediate transfer belt 25. On the secondary transfer nip, the four-color toner image on the intermediate transfer belt 25 is transferred secondarily at once onto the recording sheet by the effect of the secondary transfer electric field and the nip pressure, thus turned into a full-color image with help of an additional effect of the white color of the recording sheet.

In the copier, the secondary transfer bias having the polarity same as that of the charged polarity of toner is applied to the lower supporting roller 27 while the transfer nip roller 29 is grounded. This causes toner to electrostatically repel the lower supporting roller 27, and the repulsive force pushes toner out of the lower supporting roller 27 toward the transfer nip roller 29. Such a transfer method can be replaced with the following transfer method in which a secondary transfer bias having the polarity opposite to that of the charged polarity of toner is applied to the transfer nip roller 29 while the lower supporting roller 27 is grounded so that toner is attracted from the side of the lower supporting roller 27 to the side of the transfer nip roller 29.

On the left side of the secondary transfer nip in FIG. 2, a sheet conveying unit 50 is arranged, which operates in such a way that an endless sheet conveying belt 52 supported by a drive roller 53 and a driven roller 51 is moved endlessly. The recording sheet having passed through the secondary nip is separated from the intermediate transfer belt 25 and the transfer nip roller 29, is held on the front surface of the upper supported portion of the sheet conveying belt 52, and is conveyed by the sheet conveying belt 52 to the fixing unit 60 as the sheet conveying belt 52 moves endlessly.

Residual transfer toner having not been transferred onto the recording sheet at the secondary transfer nip adheres to the surface of the intermediate transfer belt 25 having passed through the secondary transfer nip. This residual transfer toner is scraped to be eliminated by a belt cleaning unit 28 in contact with the intermediate transfer belt 25.

The sheet conveyed to the fixing unit 60 is applied with heat and pressure in the fixing unit 60 to fix a color image to the recording sheet, after which the recording sheet is sent from the fixing unit 60 to a pair of sheet discharging rollers 35, and then is discharged from the copier.

In FIG. 1, the switchback unit 70 is arranged below the conveying unit 50 and the fixing unit 60. At this switchback unit 70, a changeover claw changes the course of the recording sheet, which has been subjected to the image fixing process on one side, toward a recording sheet turnover unit, where the recording sheet is turned over and is sent again into the secondary transfer nip. Subsequently, the secondary image transfer process and the image fixing process are carried out on the other side of the recording sheet, which is then discharged onto a sheet discharge tray.

The scanner 95 fixed on the image forming apparatus 1 includes a fixed reading unit 96 and a movable reading unit 97 both serving as reading units that read an image on a manuscript MS. The fixed reading unit 96 including a light source, reflection mirrors, and such an image reading sensor as a charge-coupled device (CCD) is arranged underneath a first exposure glass (not shown) that is fixed on the upper wall of the casing of the scanner 95 to come in contact with the manuscript MS. When the manuscript MS sent out from the ADF 91 passes over the first exposure glass, light emitted from the light source is reflected sequentially on the manuscript face to travel to the reflection mirrors, by which light is reflected to fall onto the image reading sensor. As a result, the manuscript MS is scanned without moving the optical system including the light source, reflection mirrors, etc.

The movable reading unit 97 is arranged underneath a second exposure glass (not shown) that is fixed on the upper wall of the casing of the scanner 95 to come in contact with the manuscript MS, and is located to be at the right side of the fixed reading unit in FIG. 1. The movable reading unit 97 is capable of moving an optical system including a light source, reflection mirrors, and the like. In the course of move of the optical system from the left side to the right side, light emitted from the light source is reflected on the manuscript (not shown) placed on the second exposure glass, after which light travel to the reflection mirrors, being reflected there to fall onto the image reading sensor 98. As a result, the manuscript is scanned while the optical system is moved.

The ADF 91 arranged on the scanner 95 includes a manuscript bearing board 93 on which the manuscript MS before being read is placed, a conveying unit 94 that conveys the manuscript MS, and a manuscript stack board 92*a* that stacks the read manuscript MS. The manuscript bearing board 93, the conveying unit 94, and the manuscript stack board 92*a* are held on a body cover 92. When a one-side bound manuscript, such as pages of manuscripts bound at one side into a book, is handled, the pages of manuscripts cannot be separated one by one, so that manuscript cannot be conveyed by the ADF 91. When one-side bound manuscript is handled, therefore, the openable scanner 95 is opened, and the one-side bound manuscript is placed on the exposure glass of the scanner 95 with a page to be read being opened, and then the scanner 95 is closed. The movable reading unit 97 of the scanner 95 then reads an image on the page.

In contrast, when a stack of manuscripts MS independent of each other are handled, the ADF 91 automatically conveys the stack of manuscripts MS one by one to let the fixed reading unit 96 of the scanner 95 read the manuscripts sequentially. In this case, a copy start button (not shown) is pressed after the stack of manuscripts is set on the manuscript bearing board 93. This causes the ADF 91 to send the manuscripts MS placed on the manuscript bearing board 93 one by one in decreasing order from the top to the conveying unit 94, from which the manuscript is sent further to the manuscript stack board 92*a* while being reversed in direction. In the course of the conveying process, the manuscript MS passes right above the fixed reading unit 96 just after being reversed in direction, at the point of which the fixed reading unit 96 of the scanner 95 reads an image on the manuscript MS.

The copier allows sheet feeding from a manual sheet feeding tray arranged outside the casing of the image forming apparatus 1, in addition to sheet feeding from the sheet feeding unit 80.

Figure 4:
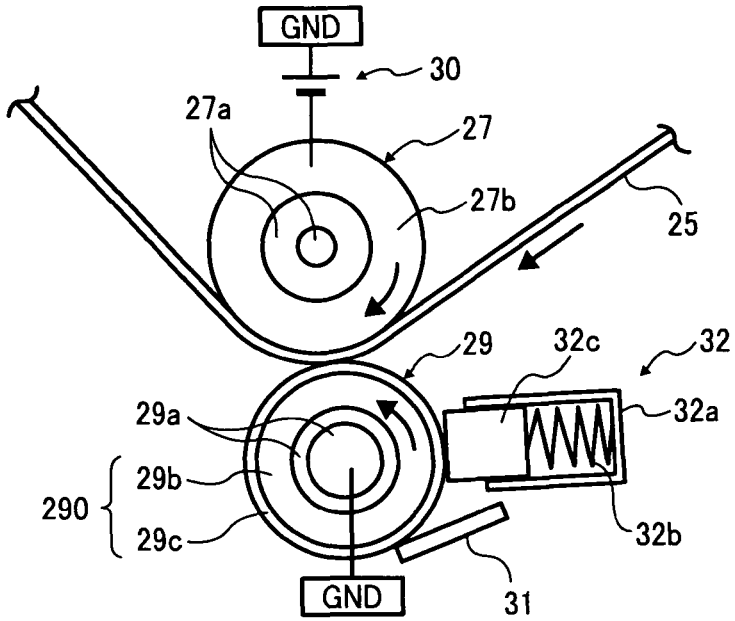
FIG. 4 is a schematic diagram of a secondary transfer nip and the periphery thereof in the image forming apparatus.

FIG. 4 is a schematic diagram of a secondary transfer nip and the periphery thereof. Referring to FIG. 4, the lower supporting roller 27 supporting the belt inside the loop of the intermediate transfer belt 25 includes a core 27*a*, and an elastic layer 27*b*. To the core 27*a* of the lower supporting roller 27, the secondary bias having the polarity same as that of toner is applied from a secondary transfer power supply 30, as shown in FIG. 4. The core 27*a* includes a roller portion made of a metal cylinder, and a shaft projecting out of both axial ends of the roller portion to be supported rotatably on a bearing (not shown). The elastic layer 27*b* is made of a conductive elastic material made by dispersing such a resin material as rubber with an ion conductive agent, covering the outer peripheral surface of the roller portion of the core 27*a* as a layer of a predetermined thickness. The elastic layer 27*b* used here must have electrical resistance of logΩ6.5 or more for the following reason. When the recording sheet is nipped in the secondary transfer nip, the area in the secondary transfer nip includes a sheet interposed area where the recording sheet is interposed between the intermediate transfer belt 25 and the transfer nip roller 29, and a direct contact area where the intermediate transfer belt 25 is in direct contact with the transfer nip roller 29. When a small-sized sheet, such as A5 sheet, is used, the direct contact area becomes relatively large. In this state, if the electrical resistance of the elastic layer 27*b* is relatively low, a current not flowing through the sheet interposed area but circling around the sheet interposed area to directly flow into the direct contact area increases to make it impossible to obtain a necessary effective transfer current (transfer current flowing through the sheet interposed area). This may lead to a transfer failure. For this reason, the electrical resistance of the elastic layer 27*b* is determined to be logΩ6.5 or more to inhibit the current's circling around into the direct contact area.

The transfer nip roller 29 sandwiching the intermediate transfer belt 25 between itself and the lower supporting roller 27 includes a core 29*a*, an elastic layer 29*b* made of a conductive elastic material, and a surface layer 29*c* made of a resin. The core 29*a* includes a roller portion made of a metal cylinder, and a shaft projecting out of both axial ends of the roller portion to be supported rotatably on a bearing (not shown). While various metal materials can be used as the material of the core 29*a*, stainless steel, aluminum, and the like are preferable as the material. The elastic layer 29*b* covers the peripheral surface of the roller portion of the core 27*a* as a layer of a predetermined thickness, exerting fine elasticity to deform the roller portion flexibly at the secondary transfer nip. The surface layer 29*c* covering the elastic layer 29*b* from the outside thereof is made of a conductive material having a foreign matter parting property superior to that of the elastic layer 29*b*, thereby suppressing filming or toner adhesion to the surface of the roller portion. Specifically, most rubber materials used for the elastic layer 29*b* have a high chemical affinity with toner and a relatively large friction coefficient, thus easily causes filming due to adhesion of foreign matter, such as sheet powder, and toner adhesion. The formation of a film causes a failure in removing toner on the roller portion surface by a cleaning blade 31 readily leading to back soiling due to reverse transfer of toner from the roller portion surface onto the back face of the recording sheet. Moreover, toner adhesion to the roller portion surface results in reverse transfer of the toner onto the back face of the recording sheet at the secondary transfer nip, thus readily leading to the back soil of the recording sheet. To prevent this, the elastic layer 29*b* is covered with the surface layer 29*c* made of a material exerting a fine foreign matter parting property.

Filming occurs on the surface of the roller portion of the transfer nip roller 29 for the following reason. In the above sheet interposed area, the recording sheet is pressed against the roller portion of the transfer nip roller 29, which causes sheet fibers and calcium carbonate contained in the recording sheet to transfer onto the roller portion. Being pressed repeatedly at the secondary transfer nip, the sheet fibers and calcium carbonate adheres to the roller portion surface, and newly pressurized sheet fibers and calcium carbonate further adheres to top of the previous one to develop filming. Particularly, some types of foreign-made coated sheets contain a large volume of calcium carbonate, and using such a type of coated sheet may cause calcium-based filming strikingly on a roller not covered with the surface layer 29*c*.

Toner adheres to the surface of the roller portion of the transfer nip roller 29 because toner adhering to the intermediate transfer belt 25 is transferred onto the surface of the roller portion of the transfer nip roller 29 in the above direct contact area.

The cleaning blade 31 is in contact with the surface of the roller portion of the transfer nip roller 29. As described above, the surface layer 29*c* exerts the fine foreign matter parting property against foreign matter, such as toner, sheet powder, and aluminum carbonate, making it difficult for foreign matter to adhere to the surface layer 29*c*. Still, the surface layer 29*c* is not capable of completely preventing foreign matter from adhering. To solve this problem, the copier is provided with the cleaning blade 31 that removes foreign matter having adhered to the roller portion surface. As the transfer nip roller 29 rotates, the cleaning blade 31 scrapes foreign matter off the surface layer 29*c*. If a film is formed on the surface layer 29*c*, however, a gap is formed between the blade and the surface layer 29*c* on the periphery of the film, so that toner passes trough the gap to cause a cleaning failure.

A lubricant applicator 32 is arranged on the right side of the transfer nip roller 29 in FIG. 4. The lubricant applicator 32 causes a spring to keep pushing a solid lubricant 32*c* encased in a hollow case 32*a* toward the transfer nip roller 29 to hold the solid lubricant 32*c* in contact with the surface of the roller portion of the transfer nip roller 29. Being kept in the contact position, the lubricant is applied to the roller portion surface after the roller portion surface passes a cleaning position, where the cleaning blade 31 carries out cleaning, and then comes into the secondary transfer nip. As a result, it is possible to suppress foreign matter from adhering to the surface layer 29*c* and improve performance of removing adhering foreign matter. For example, a solid material of a zinc stearate can be used as the solid lubricant 32*c*.

The inventors prepared a copy test machine that has the same configuration as the copier of FIG. 1 except for the absence of the lubricant applicator 32 serving as a lubricant applying unit, and conducted a test of consecutively printing prescribed test images. A recording sheet used in the test is a foreign-made sheet containing a large volume of calcium carbonate. In the test, a film made of calcium carbonate was formed and the back soil of the recording sheet due to a toner cleaning failure on the surface layer 29*c* started to happen at the point when 500 sheets were consecutively printed. In contrast, a copy test machine having the lubricant applicator 32 did not show filming on the surface layer 29*c* during consecutive printing of several ten thousands of sheets. Using the surface layer 29*c* having an inferior foreign matter parting property, however, may result in the formation of a film made of calcium carbonate. The surface layer 29*c* to use, therefore, should preferably be made of a material having a superior foreign matter parting property.

A conductive material having a superior foreign matter parting property usually shows relatively high hardness. When the surface layer 29*c* made of such a conductive material is repeatedly forced to deform pursuant to the deformation of the elastic layer 29*b* at the secondary transfer nip and is returns to the original form after passing through the secondary transfer nip, a crack due to fatigue failure eventually occurs on the surface layer 29*c*.

The characteristic configuration of the copier of the present embodiment is explained.

The inventers prepared seven types of transfer nip rollers 29 each having a covering portion 290 (combination of the elastic layer 29*b* and the surface layer 29*c*) different in characteristics from that of others. A 3-30 elastic ratio was measured on each transfer nip rollers 29.

The elastic ratio represents the ratio of an elastic workload We to a total workload Wt, and can be calculated by the equation: "elastic ratio $\eta$=elastic workload (We)/total workload (Wt)". The total workload Wt represents the workload that is done by an external force when a test subject elastic material is deformed by applying the external force to the elastic material. The elastic workload We represents the workload that is done by the elastic force of the elastic material when the elastic material reduces an amount of deformation by its elastic force upon releasing of the external force following the deformation of the elastic material. In other words, the elastic ratio represents the ratio of workload used for elastic deformation to the total workload used for deformation as whole, meaning that the higher the value of the elastic ratio, the higher rubber elasticity. A perfect elastic material shows an elastic ratio $\eta$ of 1, which means 100% of the total workload of the perfect elastic material is devoted to the elastic workload.

The above 3-30 elastic ratio is given by dividing a load 3 elastic ratio X by a load 30 elastic ratio Y. The load 3 elastic ratio X is the ratio between an elastic workload We3 and a total workload Wt3 (We3/Wt3) that is measured under a load push-in condition of 3 mN/10 seconds. The load 30 elastic ratio Y is the ratio between an elastic workload We30 and a total workload Wt30 (We30/Wt30) that is measured under a load push-in condition of 30 mN/10 seconds.

The total workload Wt and the elastic workload We can be measured by using Fisher Scope H100V (with a diamond Vickers indenter), which is a microhardness measuring instrument from Fisher Instruments K.K. Specifically, a diamond Vickers indenter is pushed in a test subject elastic material under a predetermined load push-in condition, and, following the passage of a predetermined time, the diamond Vickers indenter is pulled back at the same speed as a speed under the push-in condition. To determine the load 3 elastic ratio X, the load push-in condition of 3 mN/10 seconds. is adopted. To determine the load 30 elastic ratio Y, the load push-in condition of 30 mN/10 seconds. is adopted.

Figure 5:
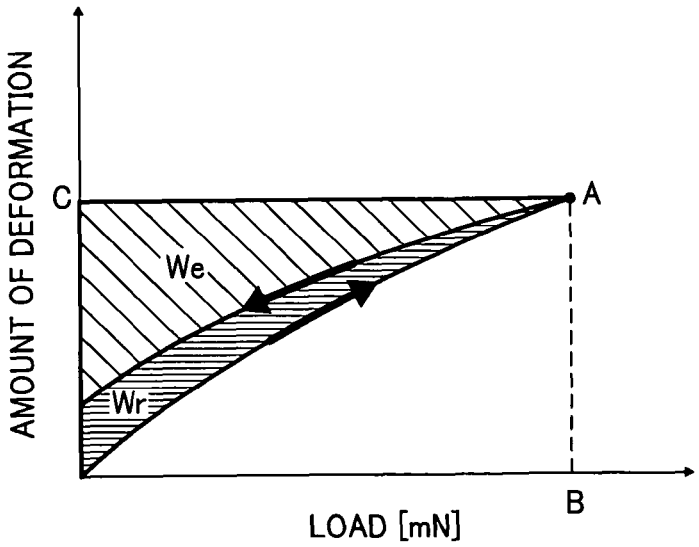
FIG. 5 is a graph representing a relation between an amount of deformation of an elastic material and a push-in load.

FIG. 5 is a graph representing a relation between an amount of deformation of an elastic material and a push-in load. As shown in FIG. 5, the amount of deformation of the elastic material increases as the push-load grows. The load is increased to a predetermined load (20 mN) in a predetermined time (10 seconds), and is stopped from increasing at a point A. The load increased to the predetermined load is then released gradually, in response to which the amount of deformation decreases gradually as shown by an arrow in FIG. 5. In FIG. 5, an oblique line portion (area of We) represents the elastic workload We, and the sum of the oblique line portion and a horizontal line portion (area of Wr) represents the total workload Wt.

The inventers paid attention to the 3-30 elastic ratio of the covering portion 290 of the transfer nip roller 29 for the following reason. Specifically, under the load push-in condition of 3 mN/10 seconds, the depth of the diamond Vickers indenter pushed into in the covering portion 290 becomes relatively small, which hardly causes the deformation of the elastic layer 29*b*. In this case, therefore, the value of the load 3 elastic ratio X is close to the elastic characteristic value of the surface layer 29*c*. In contrast, under the load push-in condition of 30 mN/10 seconds, the depth of the diamond Vickers indenter pushed into the covering portion 290 becomes relatively large, which results in the deformation of not only the surface layer 29*c* but also of the elastic layer 29*b* under the surface layer 29*c*. In this case, therefore, the value of the load 30 elastic ratio Y is the sum of the elastic characteristic value of the surface layer 29*c* and that of the elastic layer 29*b*. Thus, when the 3-30 elastic ratio is lower than "1" to a great extent, the elasticity of the elastic layer 29*b* far superior to that of the surface layer 29*c* exerts its effect to force the surface layer 29*c* to deform at the secondary transfer nip. Contrary to that, when the 3-30 elastic ratio is relatively large, no forced deformation of the surface layer 29*c* occurs, in which case crack is not formed easily.

The load 3 elastic ratio X and the load 3 elastic ratio Y were measured on prepared seven types of transfer nip rollers 29. In the measurement, each transfer nip roller 29 was set on the Fisher Scope H100V, and the diamond Vickers indenter was pushed in vertically toward the covering portion 290 of the transfer nip rollers 29 for 10 seconds, after which the indenter was pulled back.

The following is the common configuration of seven types of transfer nip rollers 29.

Material of the core 29*a*: Stainless steel

Outer diameter of the core 29*a*: 16 mm

Elastic layer 29*b*: The material of the elastic layer includes an epichlorohydrin rubber as a main material, and is adjusted in a vulcanization condition and the type and volume of an adder (e.g., conductive material) to exert desired hardness and extension characteristic.

Outer diameter of the elastic layer 29*b*: 24 mm

Surface layer 29*c*: The material of the surface layer includes an ethylene tetrafluoride resin as a main material, and is adjusted in the type and volume of a crosslinking agent to exert a desired elasticity. The material is sprayed on the outer peripheral surface of the elastic layer 29*b* to form a coat, which is dried at 140° C.

Each of seven types of transfer nip rollers 29 was incorporated in a copy test machine having the same configuration as that of the copier of FIG. 1, and the test machine was subjected to a test of consecutive printing of given test images on 300,000 recording sheets. When the back soil of the recording sheet was observed during the test, consecutive printing was suspended temporarily to check on the presence/absence of a crack on the surface layer 29*c* of the secondary transfer nip rollers 29. When a crack was confirmed, further consecutive printing was not carried out.

The following are test conditions for the lower supporting roller 27 of the copy test machine.

Material of the core 27*a*: Carbon steel pipe

Outer diameter of the core 27*a*: 16 mm

Material of the elastic layer 27*b*: ethylene propylene diene monomer (EPDM) (JIS-A55°)

Outer diameter of the elastic layer 27*b*: 24 mm

The following are test conditions for the intermediate transfer belt 25 of the copy test machine.

Material: polyimide resin

Thickness: 80 μm.

Secondary transfer nip pressure: 60 N

The result of the consecutive printing test is shown in the following table 1.

TABLE 1

| Roller type number | Load 3 elastic ratio X | Load 30 elastic ratio Y | X/Y | Presence/absence of crack formation (number of sheets at the time of crack formation) | Presence/absence of discharge mark | Friction coefficient |
|---|---|---|---|---|---|---|
| 1 | 0.13 | 0.38 | 0.47 | Absent | Absent | 0.15 |
| 2 | 0.38 | 0.52 | 0.73 | Absent | Absent | 0.25 |
| 3 | 0.42 | 0.7 | 0.60 | Absent | Absent | 0.42 |
| 4 | 0.51 | 0.65 | 0.78 | Absent | Absent | 0.50 |
| 5 | 0.18 | 0.65 | 0.28 | Present (20,000) | Absent | 0.18 |
| 6 | 0.28 | 0.69 | 0.41 | Present (250,000) | Absent | 0.23 |
| 7 | 0.15 | 0.11 | 1.36 | Absent | Present | 0.16 |

As shown in the table 1, the transfer nip roller 29 with type number 5 shows an extremely small 3-30 elastic ratio (X/Y) of 0.28. As a result, the crack was formed on the surface layer 29*c* when the type 5 transfer nip roller 29 was subjected to the test of consecutive printing of merely 20,000 sheets. The table 1 indicates that the transfer nip roller 29 achieves a long lifetime that prevents crack formation on the surface layer 29*c* under workload of consecutive printing of 300,000 recording sheets when the 3-30 elastic ratio (X/Y) is 0.47 or more. The transfer nip roller 29 with type number 7 showing a 3-30 elastic ratio (X/Y) of 1.36, however, left a discharge mark on a printed image. This discharge mark is caused by electric discharge generated in a microgap formed on the entrance or exit of the secondary transfer nip, representing a phenomenon of scattering of toner particles on the periphery of an image or of blanking out on an image. A lack of the elastic deformation of the covering portion 290 of the transfer nip roller 29 causes the roller peripheral surface to curve at the entrance or exit of the secondary transfer nip at a radius of curvature close to that of its original shape. This leads to the formation of a relatively large microgap, thus facilitating the generation of electric discharge. Seven types of transfer nip rollers 29 used in the test have surface layers 29*c* with elastic characteristics that are not different so much from each other. This fact suggests that, for the transfer nip roller 29, a relatively large 3-30 elastic ratio (X/Y) means a relatively inferior elasticity of the elastic layer 29*b*. This means that when the 3-30 elastic, ratio (X/Y) is relatively large, the elastic deformation of the covering portion 290 including the elastic layer 29*b* and the surface layer 29*c* tends to be insufficient, which facilitates the formation of a discharge mark. The table 1 indicates that discharge mark formation can be prevented when the 3-30 elastic ratio (X/Y) is 0.78 or less.

In view of such a test result, the copier uses the covering portion 290 of the transfer nip roller 29 that shows a 3-30 elastic ratio (X/Y) equal to or more than 0.47 to equal to or less than 0.78. This gives the transfer nip roller 29 a long lifetime that prevents crack formation on the surface layer 29*c* even under workload of printing of about 300,000 sheets, and prevents the formation of a discharge mark caused by an elastic deformation failure of the covering portion 290.

The surface layer 29*c* includes a fluororesin such as ethylene tetrafluoride resin as a main material. The fluororesin, which is typically known as Teflon (registered trademark), is a material that exerts a superior foreign matter parting property and a certain degree of elasticity. The fluororesin, therefore, can easily meet a condition that the foreign matter parting property of the surface layer 29*c* is superior to that of the elastic layer 29*b*, and also a condition that the 3-30 elastic ratio is 0.47 or more.

The copier uses the transfer nip roller with the surface layer 29*c* having a surface friction coefficient of 0.4 or less. Such a configuration is adopted for the following reason. When the cleaning blade 31 is set in contact with the transfer nip roller 29, as the copier is so configured, the frictional resistance between the surface layer 29*c* and the cleaning blade 31 changes depending on a state of adhesion of foreign matter to the surface layer 29*c* of the transfer nip roller 29. This readily leads to a minute change in the rotation drive speed of the transfer nip roller 29. Because the transfer nip roller 29 rotates while in contact with the intermediate transfer belt 25, a change in the rotation speed of the transfer nip roller 29 may affect the endless move speed of the intermediate transfer belt 25. When toner images each having each color on the photosensitive elements are superposed on the intermediate transfer belt 25, as the copier is so configured, a change in the speed of the intermediate transfer belt 25 causes a misalignment in the superposition of each color. Reducing a belt speed change as much as possible, therefore, is an important element for obtaining high image quality. The inventers prepared a plurality of transfer nip rollers 29 having the surface layers 29*c* with friction coefficients different from each other, and an effect given to the belt speed as a result of a linear velocity difference between the transfer nip rollers 29 and the intermediate transfer belt 25 was examined for each transfer nip roller 29. It was observed in the examination that when the friction coefficient of the surface layer 29*c* was reduced gradually, the effect given to the belt speed sharply dropped at the point that the friction coefficient is lowered to 0.4. This is the reason for adopting the surface layer 29*c* having a friction coefficient of 0.4 or less.

As described above, the elastic layer 29*b* of the transfer nip roller 29 is provided to enhance the adhesion between the roller and belt through the elastic deformation of the elastic layer 29*b* and to obtain a wide secondary transfer nip. To obtain such an effect, JIS-A hardness of the elastic layer 29*b* needs to be 80° or less. The copier thus uses the transfer nip roller 29 that has the elastic layer 29*b* having JIS-A hardness of 80° or less.

When the elastic layer 29*b* is excessively soft, however, the superior elasticity of the elastic layer 29*b* works negatively to destabilize a state of contact between the cleaning blade 31 and the roller, thus making it impossible to obtain a proper contact angle. The inventers conducted a test in which the hardness of the elastic layer 29*b* was gradually increased. The test represents that the state of contact between the blade and the roller stabilizes at the point that JIS-A hardness of the elastic layer increases to 40°. Hence, the elastic nip roller 29 having the elastic layer 29*b* having JIS-A hardness of 40° or more is adopted for the copier. More specifically, the adopted elastic layer 29*b* includes an epichlorohydrin rubber as a main material, and has JIS-A hardness of 50° or more. The elastic layer 29*b* can be made of other materials, such as EPDM dispersed with carbon powder, Si rubber, nitrile butadiene rubber (NBR) having an ion conductive function, and urethane rubber.

Figure 6:
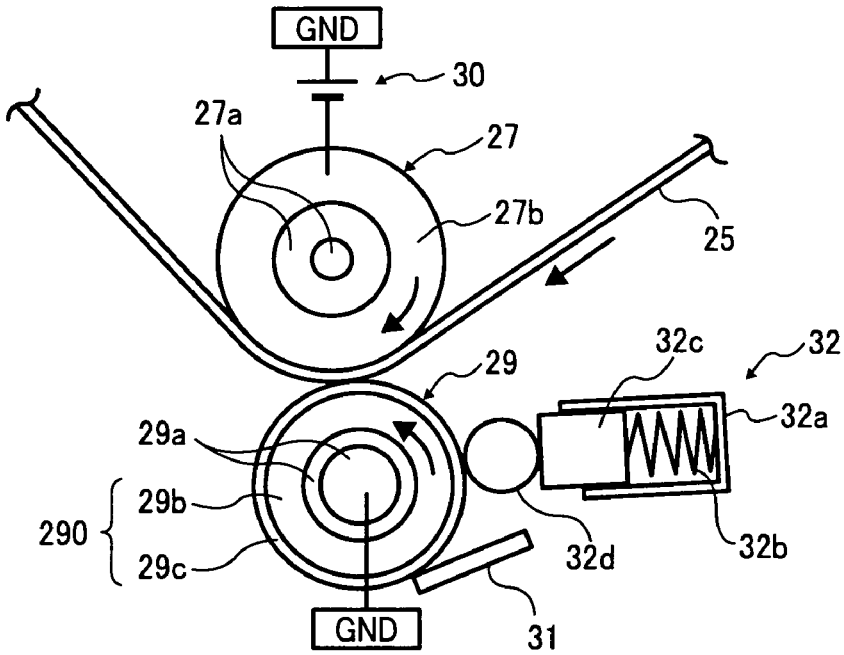
FIG. 6 is a schematic diagram of a secondary transfer nip and a periphery thereof in a modified image forming apparatus.

A modified apparatus provided as a modified example of the copier of the embodiment is described referring to FIG. 6. The configuration of the modified apparatus is the same as that of the copier unless a specific mention is made in contrary to that. In the modified apparatus, the lubricant applicator 32 has a configuration different from that of FIG. 4. Specifically, the lubricant applicator 32 of the modified apparatus has a scarping/applying member 32*d* arranged between the solid lubricant 32*c* and the transfer nip roller 29 of FIG. 4. The scarping/applying member 32*d* is driven by a driving unit (not shown) to rotate while in contact with the lubricant applicator 32 and the surface layer 29*c* of the transfer nip roller 29. While rotating, the scarping/applying member 32*d* scrapes off a powdered lubricant from the solid lubricant 32*c* to apply it to the surface layer 29*c* of the transfer nip roller 29. In comparison with the configuration in which just the solid lubricant 32*c* is set in contact with the surface layer 29*c*, this configuration offers an advantage that a greater amount of the lubricant can be applied to the surface layer 29*c*, and that a lubricant application amount per unit time can be adjusted through adjustment of the rotation speed of the scarping/applying member 32*d*.

The above scarping/applying member 32*d* is provided, for example, as a scraping/applying brush roller having a rotating shaft supported rotatably and a roller-shaped brush that is erected on the outer peripheral surface of the rotating shaft and that includes a plurality of brush hairs. Such a scraping/applying brush roller temporarily can trap a scraped lubricant in the brush and apply the trapped lubricant to the surface layer 29*c*.

Furthermore, the scarping/applying member 32*d* can be provided as a scraping/applying roller having a rotating shaft supported rotatably and an elastic layer made of foam and covering the outer peripheral surface of the rotating shaft. Such a scraping/applying expandable roller temporarily traps a lubricant scarped off by the expandable elastic layer in expandable cells of the expandable elastic layer and applies the lubricant to the surface layer 29*c*.

In the copier of the embodiment, the copier uses the covering portion 290 of the transfer nip roller 29 that represents the value of 0.7 or less that is obtained by dividing the load 3 elastic ratio X, which is the ratio between the elastic workload We3 and the total workload Wt3, by the load 30 elastic ratio Y, which is the ratio between the elastic workload We30 and the total workload Wt30. In this configuration, as the inventers represented in the tests, the formation of a discharge mark due to an elastic deformation failure of the cover can be prevented.

The copier of the embodiment uses the surface layer 29*c* of the transfer nip roller 29 that includes a fluororesin as a main material. This configuration easily meets a condition that the foreign matter parting property of the surface layer 29*c* is superior to that of the elastic layer 29*b*, and also a condition that the 3-30 elastic ratio of the surface layer 29*c* is 0.47 or more.

The copier of the embodiment uses the surface layer 29*c* that has a surface friction coefficient of 0.4 or less. This configuration, as described above, suppresses a misalignment in superposing toner images of each color caused by a change in the rotation speed of the transfer nip roller 29.

The copier of the embodiment uses the elastic layer 29*b* of the transfer nip roller 29 that has JIS-A hardness of 40° or more to 80° or less. This configuration, as described above, certainly offers an effect that the deformation of the elastic layer 29*b* improves the adhesion between the transfer nip roller 29 and the intermediate transfer belt 25, and that a wide secondary transfer nip is obtained.

The copier of the embodiment is provided with the cleaning blade 31 serving as a cleaning unit that removes toner adhered to the surface layer 29*c* of the transfer nip roller 29. In this configuration, the cleaning blade 31 immediately removes foreign matter having adhered to the surface layer 29*c* to suppress the formation and growth of a film on the surface layer 29*c*.

The copier of the embodiment is provided with the lubricant applicator 32 serving as a lubricant applying unit that applies a lubricant to the surface layer 29*c* of the transfer nip roller 29. In this embodiment, foreign matter does not adhere to the surface layer 29*c* easily and parting of foreign matter adhered to the surface layer 29*c* is facilitated by applying the lubricant; thereby suppressing the formation and growth of a film on the surface layer 29*c*.

The copier of the embodiment uses the lubricant applicator 32 that brings the solid lubricant 32*c* in contact with the surface layer 29*c*. In this configuration, the lubricant is applied to the surface layer 29*c* using the rotation driving force of the transfer nip roller 29 without employing a dedicated drive mechanism for applying the lubricant.

The modified apparatus uses another type of the lubricant applicator 32 that causes the scraping/applying member to scrape off the lubricant from the solid lubricant 32*c* and apply the scraped lubricant to the surface layer 29*c*. In comparison with the configuration in which just the solid lubricant 32*c* is set in contact with the surface layer 29*c*, this configuration offers an advantage that a greater amount of the lubricant can be applied to the surface layer 29*c*, and that a lubricant application amount per unit time can be adjusted through adjustment of the rotation speed of the scarping/applying member 32*d*.

According to one aspect of the present invention, as is apparent from the tests described above, the covering portion covering the core of the transfer nip roller is provided, in which the ratio (We3/Wt3)/(We30/Wt30) is 0.5 or more, so that the transfer nip roller has no crack formation even after going through printing of 300,000 sheets. As a result, the transfer nip roller can have a longer life.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer nip roller operative to transfer an image from an image carrier to a recording medium, the transfer nip roller comprising:

a core connected to an electrical ground;

a covering portion that covers a surface of the core and includes an elastic layer on a surface of the core and a surface layer on the elastic layer, wherein the covering portion is configured such that a 3-30 elastic ratio (We3/Wt3)/(We30/Wt30) of the covering portion is 0.47 or more, where We3 is an elastic workload and Wt3 is a total workload measured by applying a load on the covering portion under a load push-in condition of 3 mN/10 seconds, and We30 is an elastic workload and Wt30 is a total workload measured by applying a load on the covering portion under a load push-in condition of 30 mN/10 seconds.

2. The transfer nip roller according to claim 1, wherein the ratio (We3/Wt3)/(We30/Wt30) is in a range of 0.47 and 0.78.

3. The transfer nip roller according to claim 1, wherein the surface layer includes fluororesin as a main component.

4. The transfer nip roller according to claim 1, wherein the surface layer has a surface friction coefficient of 0.4 or less.

5. A transfer device comprising:

an image carrier that carries a toner image on a surface thereof; and a transfer nip roller connected to an electrical ground, the transfer nip roller being in surface contact with the image carrier and operative to transfer an image from the image carrier to a recording medium passing between a nip formed by the image carrier and the transfer nip roller, the transfer nip roller including a core;

a covering portion that covers a surface of the core and includes an elastic layer on a surface of the core and a surface layer on the elastic layer, wherein the covering portion is configured such that a 3-30 elastic ratio (We3/Wt3)/(We30/Wt30) of the covering portion is 0.47 or more, where We3 is an elastic workload and Wt3 is a total workload measured by applying a load on the covering portion under a load push-in condition of 3 mN/10 seconds, and We30 is an elastic workload and Wt30 is a total workload measured by applying a load on the covering portion under a load push-in condition of 30 mN/10 seconds.

6. The transfer device according to claim 5, wherein the ratio (We3/Wt3)/(We30/Wt30) is in a range of 0.47 and 0.78.

7. The transfer device according to claim 5, wherein the image carrier is an intermediate transfer body onto a surface of which a toner image formed on a surface of a latent image carrier of an image forming apparatus is intermediately transferred.

8. The transfer device according to claim 5, further comprising a cleaning unit that removes toner adhered to the surface layer of the transfer nip roller.

9. The transfer device according to claim 5, further comprising a lubricant applying unit that applies a lubricant to the surface layer of the transfer nip roller.

10. The transfer device according to claim 9, wherein the lubricant is a solid lubricant.

11. The transfer device according to claim 9, wherein the lubricant is a solid lubricant, and the lubricant applying unit includes a scraping member that scraps off lubricant from the solid lubricant and applies the lubricant to the surface layer.

12. The transfer device according to claim 10, wherein the solid lubricant is a solid material of a zinc stearate.

13. The transfer device according to claim 11, wherein the solid lubricant is a solid material of a zinc stearate.

14. An image forming apparatus comprising:

a transfer device including an image carrier that carries a toner image on a surface thereof; and a transfer nip roller connected to an electrical ground, the transfer nip roller being in surface contact with the image carrier and operative to transfer an image from the image carrier to a recording medium passing between a nip formed by the image carrier and the transfer nip roller, the transfer nip roller including a core;

a covering portion that covers a surface of the core and includes an elastic layer on a surface of the core and a surface layer on the elastic layer, wherein the covering portion is configured such that a 3-30 elastic ratio (We3/Wt3)/(We30/Wt30) of the covering portion is 0.47 or more, where We3 is an elastic workload and Wt3 is a total workload measured by applying a load on the covering portion under a load push-in condition of 3 mN/10 seconds, and We30 is an elastic workload and Wt30 is a total workload measured by applying a load on the covering portion under a load push-in condition of 30 mN/10 seconds.

15. The image forming apparatus according to claim 14, wherein the ratio (We3/Wt3)/(We30/Wt30) is in a range of 0.47 and 0.78.

16. The transfer device according to claim 5, wherein the surface layer includes fluororesin as a main component.

17. The image forming apparatus according to claim 14, wherein the surface layer includes fluororesin as a main component.

18. The transfer device according to claim 8, wherein the cleaning unit is a cleaning blade.

19. The image forming apparatus according to claim 17, further including a cleaning blade in contact with a surface of the nip roller.

20. The transfer nip roller according to claim 1, wherein the elastic layer has a JIS-A hardness of greater than 60° and less than 80°.

* * * * *

UNITED STATES PATENT AND TRADEMARK OFFICE

CERTIFICATE OF CORRECTION

PATENT NO. : 8,270,886 B2
APPLICATION NO. : 12/073394
DATED : September 18, 2012
INVENTOR(S) : Minbu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 876 days.

Signed and Sealed this
Fifteenth Day of July, 2014

Michelle K. Lee

Michelle K. Lee
*Deputy Director of the United States Patent and Trademark Office*